United States Patent [19]

Guelck

[11] Patent Number: 4,656,782

[45] Date of Patent: Apr. 14, 1987

[54] HORIZONTAL SLIDER CLOSURE

[76] Inventor: Volker Guelck, 114 Columbia St. West, Waterloo, Ontario, Canada, N2L 3K8

[21] Appl. No.: 795,893

[22] Filed: Nov. 7, 1985

[30] Foreign Application Priority Data

Nov. 13, 1984 [CA] Canada ..... 467660

[51] Int. Cl.[4] ..... E05D 15/06

[52] U.S. Cl. ..... 49/404

[58] Field of Search ..... 49/404, 408, 501, 504

[56] References Cited

U.S. PATENT DOCUMENTS 3,859,754 1/1975 Budich et al. ..... 49/504 X 4,227,346 10/1980 Kabik ..... 49/501 X

FOREIGN PATENT DOCUMENTS 2504183 10/1982 France ..... 49/501

*Primary Examiner*—Kenneth Downey

*Attorney, Agent, or Firm*—Daryl W. Schnurr

[57] ABSTRACT

A horizontal slider window has an outer monorail that is approximately the same length as the outer sash. The outer monorail supports the outer sash and slides with said sash relative to a sill of the window. The outer monorail is maintained in a parallel position relative to an inner monorail by guide means located between the two monorails. The outer monorail rests on the sill and the guide means is protected from the elements. When the window is in a closed position, the outer monorail does not extend beyond the outer sash and therefore water cannot collect between the two monorails.

24 Claims, 6 Drawing Figures

HORIZONTAL SLIDER CLOSURE

BACKGROUND OF THE INVENTION

1. FIELD OF THE INVENTION

This invention relates to a horizontal slider closure and, in particular, to horizontal slider windows made of extruded plastic.

2. DESCRIPTION OF THE PRIOR ART

It is known to have horizontal slider windows. However, with previous windows, the monorails supporting the two sashes are usually an integral part of the sill and extend from one side to another of a frame of said window. When this type of window is in a closed position, approximately one-half of the outer monorail is exposed to ambient air. Often, the sill or outer monorail has drain holes therein so that any water trapped between the two monorails can escape. However, these drain holes can become clogged and the water can leak into the building in which the window is installed. When the weather is cold, any water trapped between the two monorails can freeze, thereby causing damage to the window. Also, the drain holes can provide an entrance for insects.

SUMMARY OF THE INVENTION

It is an object of the present invention to provide a horizontal slider closure where no part of the outer monorail extends beyond the outer sash and, when the closure is in a closed position, no water can collect between the two monorails.

In accordance with the present invention, a horizontal slider closure has an inner panel and an outer panel mounted in a frame. The frame is rectangular in shape and has a sill that slopes downward and outward. The sill has an inner monorail and an outer monorail located thereon, each monorail supporting one panel. The outer monorail and the outer panel are slidable together relative to said sill, with guide means for said outer monorail so that said monorails are always substantially parallel to one another.

Preferably, the outer monorail has a length substantially equal to the length of said outer panel.

DESCRIPTION OF A PREFERRED EMBODIMENT

Figure 1:
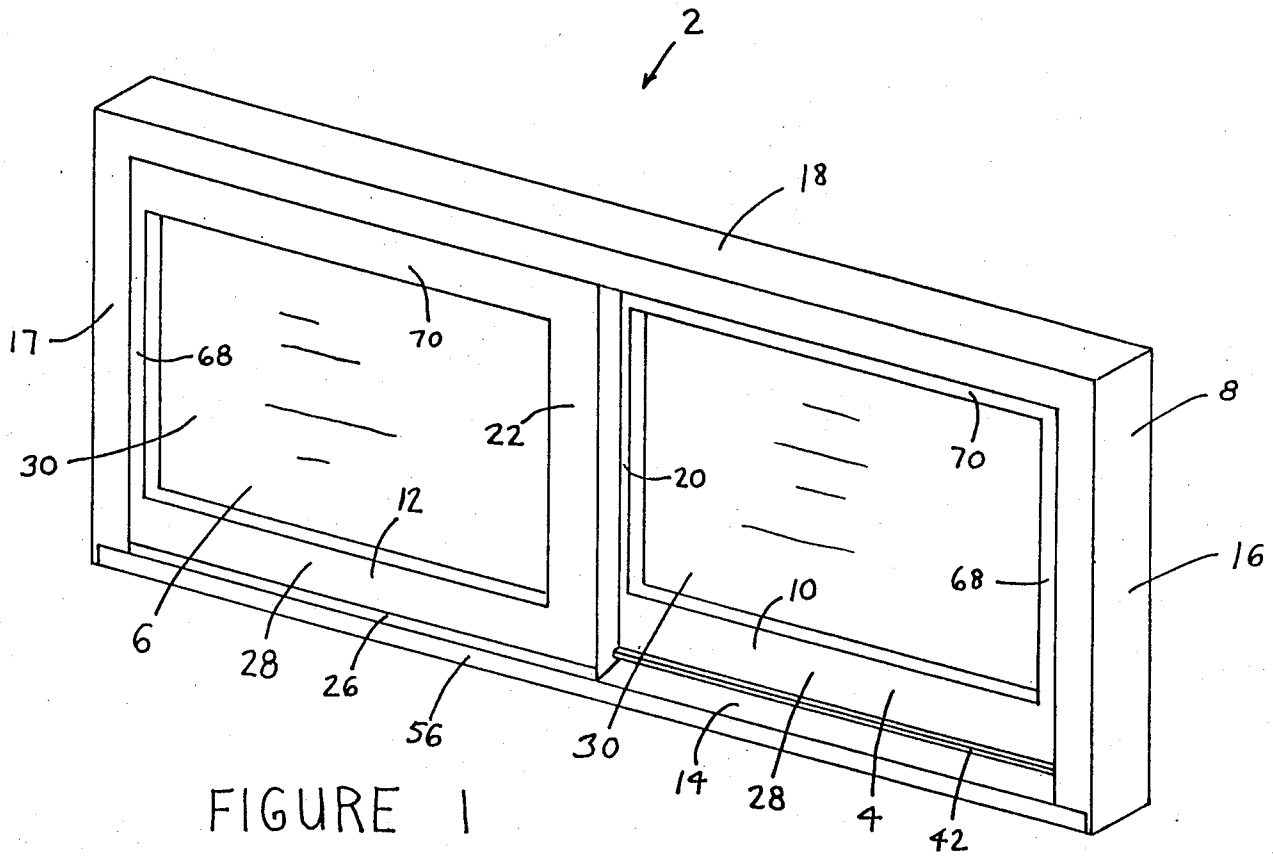
FIG. 1 is a perspective view of a window in a closed position.
Figure 2:
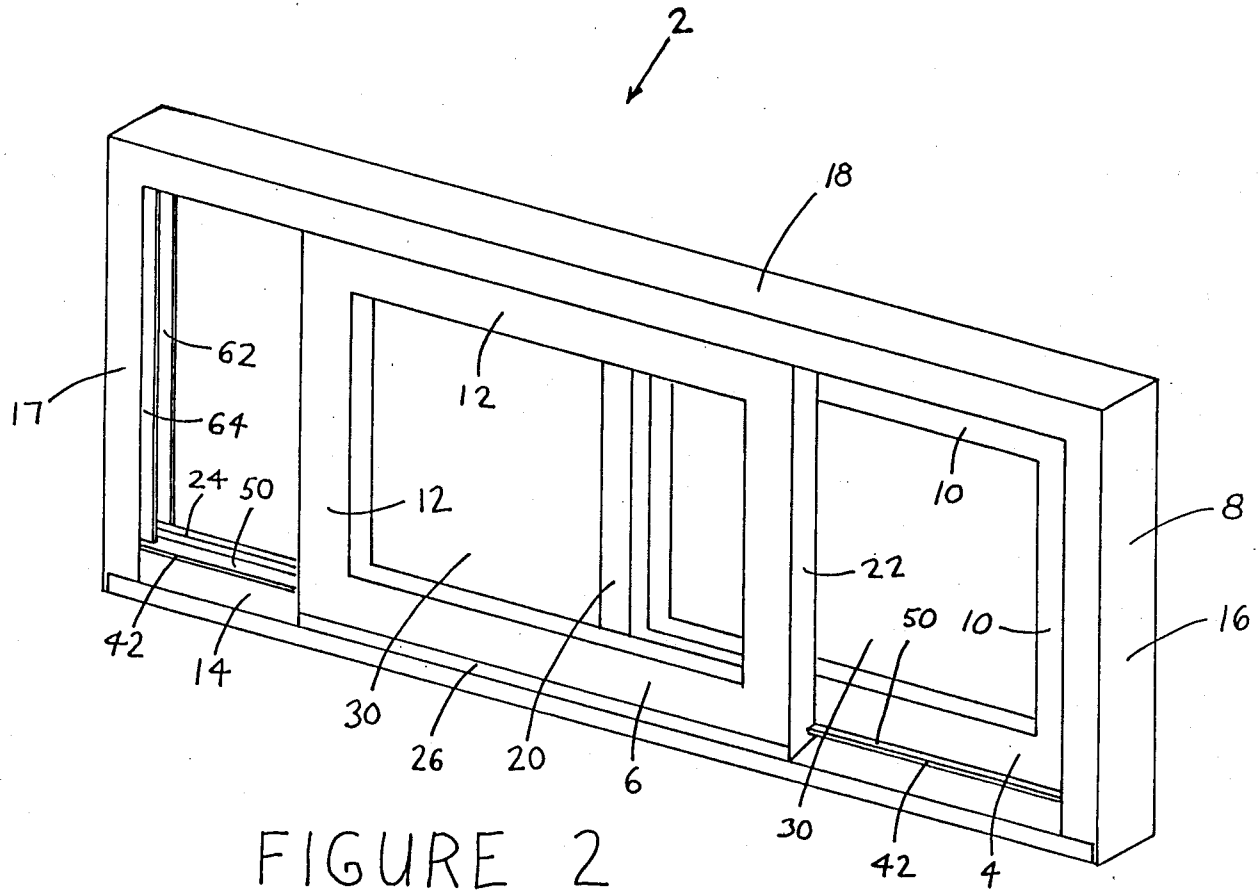
FIG. 2 is a perspective view of a window in a partially open position.

Referring to the drawings in greater detail, in FIG. 1, there is shown a horizontal slider window or panel 2 having an inner sash or panel 4 and an outer sash or panel 6 mounted in a frame 8. The window 2 of FIG. 1 is shown in a closed position and each sash 4, 6 has a border 10, 12 respectively. The frame 8 has a sill 14, two jambs 16, 17 and a head 18. The borders 10, 12 have interlocks 20, 22 respectively. In FIG. 2, the window 2 is shown in a partially open position.

Figure 4:
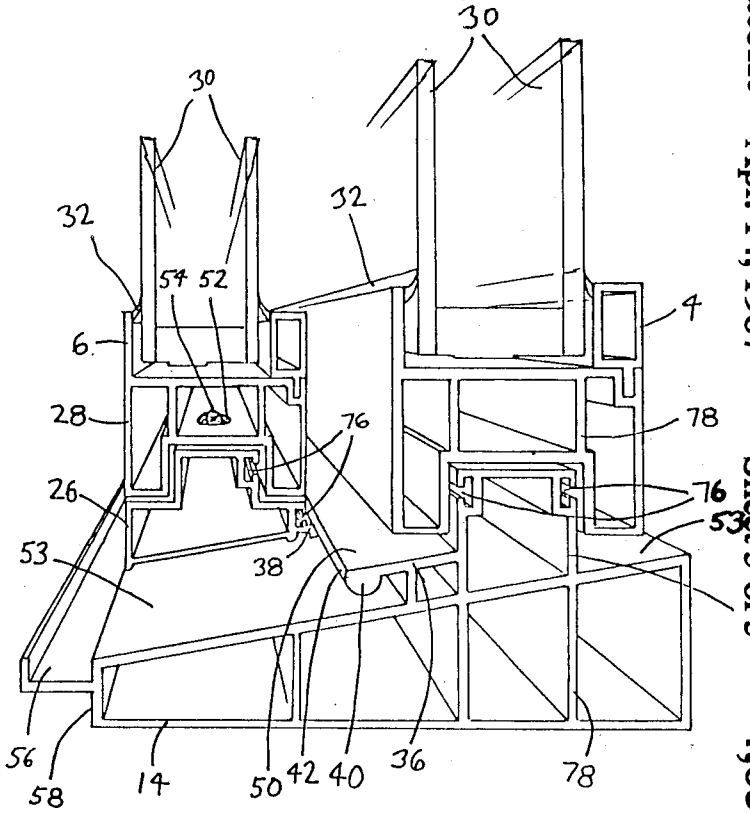
FIG. 4 is a perspective end view of a sill and an inner and outer monorail, with coverings removed, when an outer monorail has been moved towards a closed position relative to said inner monorail.
Figure 3:
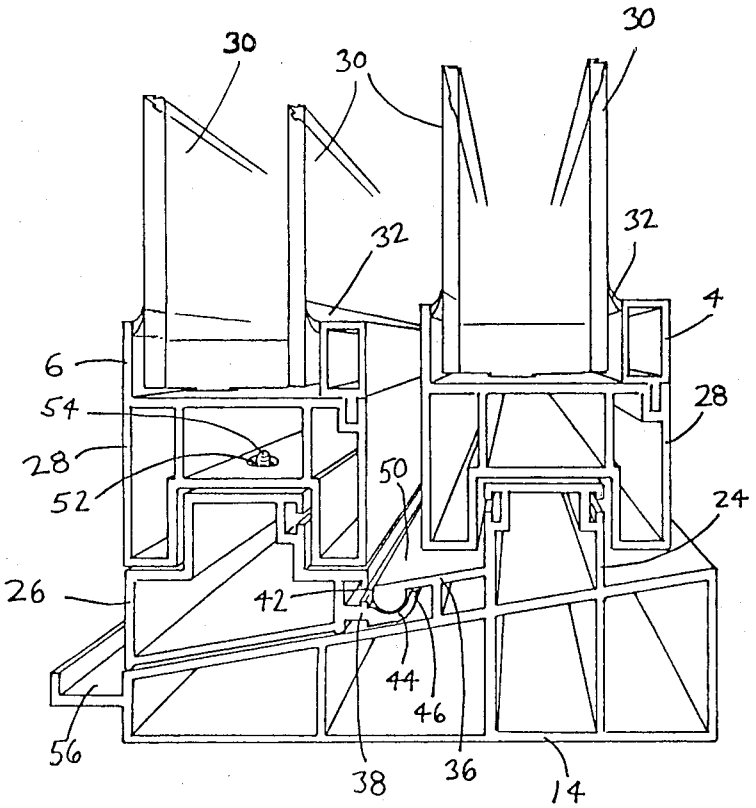
FIG. 3 is a partial perspective view of an end of a sill and an inner and outer monorail, with coverings removed, when the two monorails are adjacent to one another.

Referring to FIGS. 3 and 4 in greater detail, the jamb 16, the interlock 20 and part of the borders 10, 12 have been removed to expose ends of the sill 14, monorails 24, 26 and sashes 4, 6. The sill 14 slopes downward and outward, said sill having an inner monorail 24 and an outer monorail 26 located thereon. The inner monorail supports the inner sash 4 and the outer monorail supports the outer sash 6. The inner sash 4 has a base 28, being part of the border 10, with two panes 30 of glass mounted therein. Flexible seals 32 prevent moisture and air from leaking into the base 28 past the panes 30. The outer monorail 26 supports the outer sash 6 which has a base 28, being part of the border 12, panes 30 and flexible seals 32 identical to those of the inner monorail 24. The inner monorail 24 is an integral part of the sill 14 and extends along the entire length of the sill 14 between the two jambs 16, 17. The inner sash 4 is slidable relative to the inner monorail 24.

The outer monorail 26 is not an integral part of the sill 14 but simply rests on an upper surface 34 of said sill. The outer sash 6 is not slidable, when properly installed, relative to the outer monorail 26. The outer monorail 26 and the outer sash 6 are slidable together relative to said sill 14. The outer monorail 26 has a length approximately equal to one-half of the length of the sill 14. The inner monorail 24 has a length approximately equal to the length of the sill 14.

Guide means ensure that the two monorails are always substantially parallel to one another. The guide means are located between the two monorails 24, 26. Protrusions 36, 38 are located on the sill 14 and outer monorail 26 respectively and removably interlock with one another so that the outer monorail 26 can slide relative to said sill 14. The protrusion 36 has a rounded ridge or lip 40 along a free end 42. The protrusion 38 has an indentation or hook 44 along a free end 46.

As can be best seen from FIG. 3, the ridge 40 removably interlocks with the indentation 44 so that the outer monorail is slidable relative to the inner monorail 24. As can be seen from FIGS. 1 and 2, the outer monorail 26, though one end is hidden in FIGS. 1 and 2 by the interlock 20, has a length substantially equal to the length of the outer sash 6. An outer face of the outer monorail 26 can be seen in FIGS. 1 and 2 beneath the sash 6. While in FIGS. 3 and 4, the ridge of the lip 40 is shown on the protrusion 36 of the sill 14 and the indentation or hook 44 is shown on the protrusion 38 of the outer monorail 26, these could be reversed so that the protrusion of the sill had the indentation and protrusion of the outer monorail had the ridge. As a further alternative, the guide means could be designed so that a protrusion on one of the outer monorail and the sill would interlock with an indentation on the other of the outer monorail and the sill.

The protrusion 36 of the sill 14 is an integral part of the sill and the protrusion 38 of the outer monorail 26 is an integral part of said monorail. The protrusion 36 extends outward from an outer side 48 of said inner monorail 24. The protrusion 36 has an upper surface 50 that slopes downward and outward with the ridge 40 located at a free end 42. The protrusion 36 and ridge 40 extend the full length of the sill 14. The protrusion 38 and indentation 44 extend the full length of the outer monorail 26.

As can best be seen from FIG. 4, there are means to prevent the outer sash 6 from sliding relative to the outer monorail 26. The base 28 of the outer monorail 26 has an opening 52 therein with an abutment 54 located on the outer monorail 26 and extending into the opening 52. Since the abutment 54 fits snugly within the opening 52, the outer sash 6 cannot slide relative to the monorail 26.

By comparing FIGS. 3 and 4, it can be seen that the outer sash 6 and the outer monorail 26 slide together relative to the inner monorail 24. Since the outer monorail 26 is the same length as the outer sash 6, when the window is in a closed position, no water can collect between the two monorails 24, 26. Except for the outer face as shown in FIG. 1, the outer monorail 26 is not exposed to the elements when the window 2 is in a closed position. Therefore, water cannot become trapped between the two monorails and ultimately cause damage. Even when the window is in an open position, water cannot become trapped between the two monorails as the entire outer monorail 26 is located beneath the sash 6. If water were to enter the space between the two monorails, it would readily drain along the length of the outer monorail 26 and ultimately onto the sloped sill 14. If the window 2 of the present invention is left open through neglect, while water can enter the building in which the window is installed, there is no place on the inner monorail where water can become trapped. Any water deposited on that portion of the sill outside of the inner monorail will flow by gravity along the slope of the sill to the outside. In FIGS. 1 to 4, it can be seen that there is a channel 56 located at a front 58 of the sill 14. The purpose of the channel 56 is to support a screen (not shown) for the window 2. The screen can be a full screen or a half screen and can be held in place by clips (not shown). It is considered that the screen is conventional and it is therefore not further described.

Figure 5:
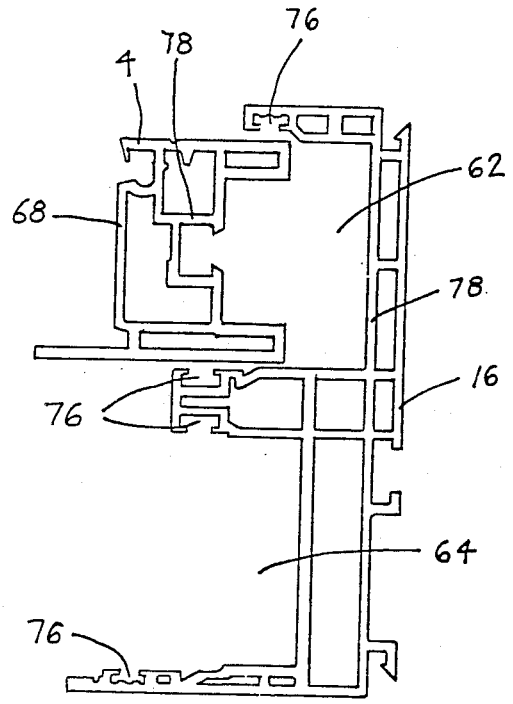
FIG. 5 is a sectional view of a jamb and part of a sash of said window.

Referring to FIG. 5 in greater detail, there is shown a cross-sectional view of the jamb 16 and part of the sash 4 of the window 2. The jamb 16 has an inner channel 62 and an outer channel 64. The jamb 17 has the same two channels 62, 64 as shown in FIG. 2. The channels 62, 64 are designed to receive the borders 10, 12 respectively depending on the position of the window. When the window 2 is closed, part of the border 10 of the sash 4 is in the channel 62 of the jamb 16 and part of the border 12 of the sash 6 is in the channel 64 of the jamb 17. In FIG. 5, part of the border 10 of the sash 4 is partially within the channel 62.

Figure 6:
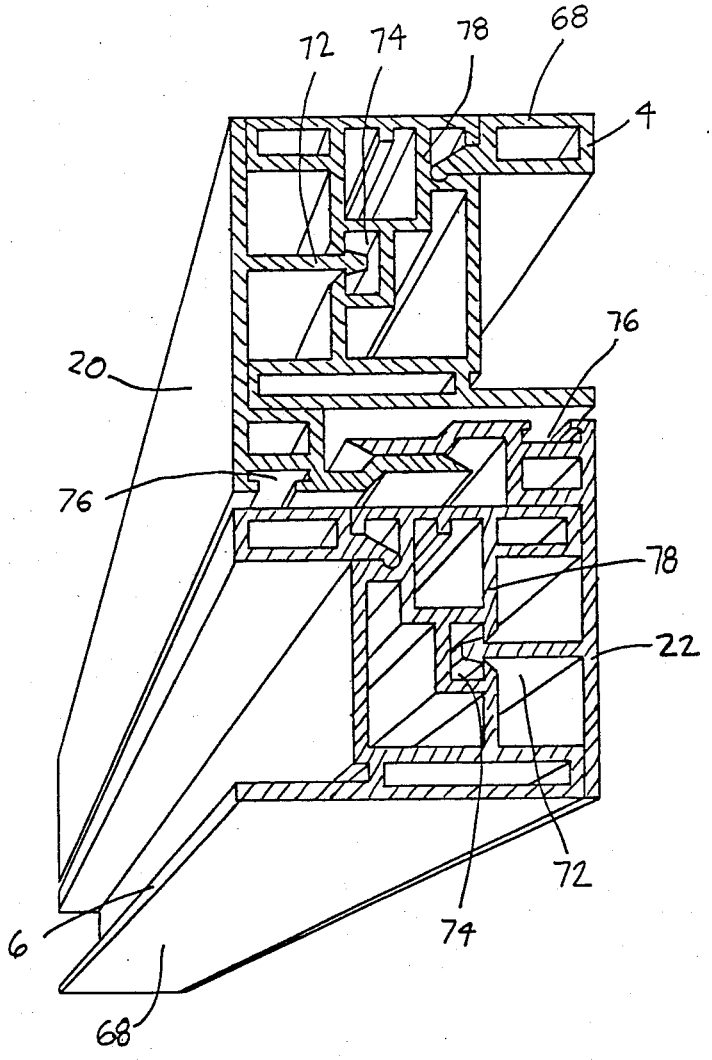
FIG. 6 is a sectional view of an interlock section when said window is in a closed position.

Referring to FIG. 6 in greater detail, there is shown a perspective end view of the interlocks 20, 22 of the inner sash 4 and the outer sash 6 respectively. The interlocks are shown in a closed position and the ends of the interlock 20, 22 have different cross-hatching to distinguish the two interlocks from one another.

The sash 4 has a border 10 surrounding two panes of glass 30. The sash 6 has a border 12 surrounding two panes of glass 30. Each of the borders 10, 12 of the sashes 4, 6 respectively has a base 28, two sides 68, a top 70 and an interlock 20, 22. Preferably, the base 28, sides 68 and top 70 of both borders 10, 12 all have an identical cross-section. The interlocks 20, 22 each clip into one side 68 of the sashes 4, 6 respectively by means of a ridge 72 which fits snugly into a channel 74. While the sides 68 of the sashes 4, 6 of FIGS. 5 and 6 have a different cross-section than the bases 28 of the sashes 4, 6 of FIG. 3, this is merely a variation in design. The head 18 can have an identical cross-section to the jamb 16, thereby resulting in cost savings. Since the head 18 can be identical to the jamb 16, there is no cross-sectional view of the head 18. Also, the jamb 17 has a cross-section that is a mirror image to the jamb 16. In other words, the jamb 16 can simply be inverted to make the jamb 17.

As can be seen from FIGS. 3.and 4, the sill 14 is divided into two parts by the guide means. A surface 53 of the sill 14 outside of the guide means is at a lower level than the surface 53 of the sill 14 inside the guide means.

Preferably, the window, except for the glass portion and the seals, is extruded from a suitable plastic. Suitable plastics are known to those skilled in the art. One particular plastic that is suitable is poly vinyl chloride Many of the seals are conventional and have been omitted from the drawings so that the plastic structure can be clearly set out. Synthetic brush seals, for example nylon seals, are conventional in window fabrication and, for information purposes only, brush seals would be located in T-shaped channels 76 as shown in FIG. 4, FIG. 5 and FIG. 6. Other locations of seals 32, 76, in addition to those shown, will be readily apparent to those skilled in the art.

As with conventional windows, there is a space (not shown) between the top 70 of each frame 10, 12 and the head 18 so that the sashes 4, 6 can be removed by first lifting them upwards and then inwards as the base 28 clears each monorail. The abutment 54 is designed in such a way that it will prevent lateral movement of the sash 6 relative to the monorail 26 but will not prevent the sash 6 from being lifted up relative to the monorail 26. After the outer sash 6 has been removed, the outer monorail 26 can be removed from the sill 14 by rotating said monorail in a clockwise direction about the ridge 40 until such time as the indentation 44 becomes disengaged from the ridge 40.

As can be seen from FIGS. 3 to 6 inclusive, the plastic parts are hollow with numerous reinforcing ribs 78 extending throughout. In this manner, it is possible to achieve light-weight, inexpensive and strong windows. Since the outer monorail 26 is not rigidly affixed to the sill 14, the same sill 14 can be used for a double hung window. This can result in a significant cost saving in producing windows as it is not necessary to produce one type of sill for one window and another type of sill for a different window. In a further variation of the window 2, wheels or bearings could be located between the base of the inner sash and the inner monorail or between the outer monorail and the sill. Other variations within the scope of the attached claims will be readily apparent to those skilled in the art.

What I claim as my invention is:

1. A horizontal slider closure having an inner panel and an outer panel mounted in a frame, said frame being rectangular in shape and having a sill that slopes downward and outward, said sill having an inner monorail and an outer monorail located thereon, each monorail supporting one panel, said outer monorail and said outer panel being slidable together relative to said sill with guide means for said outer monorail so that said monorails are always substantially parallel to one another.

2. A closure as claimed in claim 1 wherein said outer monorail has a length substantially equal to the length of said outer panel.

3. A closure as claimed in claim 2 wherein the guide means is located between the two monorails.

4. A closure as claimed in claim 3 wherein the inner monorail extends from one side of the frame to the other and the inner panel is slidable on said inner monorail.

5. A closure as claimed in claim 4 wherein the guide means is a protrusion located on each of the sill and the outer monorail, said protrusions removably interlocking with one another so that said outer monorail can slide relative to said sill.

6. A closure as claimed in claim 5 wherein the protrusion on one of said outer monorail and said sill has a ridge along a free end and the protrusion on the other end of said outer monorail and said sill has an indentation along a free end, said ridge being removably interlocked in said indentation so that said outer monorail is slidable relative to said sill.

7. A closure as claimed in claim 6 wherein the ridge is located on the protrusion of said sill and the indentation is located on the protrusion of said outer monorail.

8. A closure as claimed in any one of claims 6 or 7 wherein the protrusion on said sill is an integral part of said sill and the protrusion on said monorail is an integral part of said monorail.

9. A closure as claimed in any one of claims 6 or 7 wherein the inner monorail is an integral part of said sill and the protrusion on said sill extends outward from an outer side of said inner monorail, said protrusion having an upper surface that slopes downward and outward with the ridge located at a free end beneath said upper surface.

10. A closure as claimed in claim 6 wherein the guide means is a protrusion on one of said outer monorail and the sill and an indentation on the other of said outer monorail and the sill.

11. A closure as claimed in claim 6 wherein the protrusion is located on the outer monorail and the indentation is located on the sill.

12. A window as claimed in claim 6 wherein the protrusion is on said sill and the indentation is on said outer monorail.

13. A window as claimed in any one of claims 10, 11 or 12 wherein the protrusions and indentations extend the full length of said sill and inner monorail.

14. A closure as claimed in claim 6 wherein the ridge is a lip along said sill and the indentation is a hook along said outer monorail, said lip and hook interlocking with one another.

15. A closure as claimed in any one of claims 1, 10, or 14 wherein, except for a glass see-through portion, the closure is made of a suitable plastic, the plastic parts being hollow with reinforcing ribs extending therethrough.

16. A closure as claimed in claim 1 wherein the sill is divided into two parts by said guide means, a surface of the sill outside of said guide means being at a lower level than a surface of said sill inside said guide means.

17. A closure as claimed in claim 2 wherein there are means to prevent the outer monorail from sliding relative to said outer panel.

18. A closure as claimed in claim 17 wherein the means to prevent the outer monorail from sliding relative to said outer panel is an abutment located on one of the outer monorail and said outer sash and an opening located on the other of said outer monorail and said outer sash, with said abutment extending into said opening.

19. A closure as claimed in claim 16 wherein that part of the guide means on the outer monorail extends along the full length of said monorail.

20. A closure as claimed in claim 19 wherein that part of the guide means on the sill extends along the full length of said sill.

21. A closure as claimed in claim 2 wherein the closure is a window and the frame has two jambs and a head, the inner monorail is an integral part of said sill, the inner panel is an inner sash that is slidable relative to said inner monorail.

22. A window as claimed in claim 21 wherein the inner monorail extends from one jamb to the other.

23. A closure as claimed in claim 21 wherein the head of the window has a cross-section identical to a cross-section of each jamb.

24. A horizontal slider window having an inner sash and an outer sash mounted in a frame, said frame being rectangular in shape and having a sill that slopes downward and outward, said sill having an inner monorail and an outer monorail located thereon, each monorail supporting one sash, said outer monorail and said outer sash being slidable together relative to said sill, with guide means so that said monorails are always substantially parallel to one another, said guide means being a protrusion located on each of the sill and the outer monorail, said protrusions removably interlocking with one another so that said outer monorail can slide relative to said sill.

* * * * *